United States Patent [19]

Mishima

[11] 4,154,132

[45] May 15, 1979

[54] RHYTHM PATTERN VARIATION DEVICE

[75] Inventor: Toshio Mishima, Shobu, Japan

[73] Assignee: Kabushiki Kaisha Kawai Gakki Seisakusho, Hamamatsu, Japan

[21] Appl. No.: 838,500

[22] Filed: Oct. 3, 1977

[30] Foreign Application Priority Data

Oct. 7, 1976 [JP] Japan ..... 51/120750
Oct. 7, 1976 [JP] Japan ..... 51/120751

[51] Int. Cl.[2] ..... G10H 1/00; G10H 5/00

[52] U.S. Cl. ..... 84/1.03; 84/1.22; 84/1.24; 84/DIG. 12

[58] Field of Search ..... 84/1.03, 1.24, DIG. 12, 84/DIG. 26, 1.22

[56] References Cited

U.S. PATENT DOCUMENTS

| | | | |
|---|---|---|---|
| 3,624,263 | 11/1971 | Uchiyama | 84/1.03 |
| 3,681,531 | 8/1972 | Burkhard et al. | 84/DIG. 26 |
| 3,708,602 | 1/1973 | Hiyama | 84/1.03 |
| 3,749,837 | 7/1973 | Doughty | 84/1.03 X |
| 3,816,637 | 6/1974 | Whitefield | 84/1.24 |
| 3,833,752 | 9/1974 | Van Der Kooij | 84/1.24 |
| 4,012,982 | 3/1977 | Southard | 84/1.24 X |
| 4,014,167 | 3/1977 | Hasegawa et al. | 84/1.03 X |
| 4,072,078 | 2/1978 | Shallenberger et al. | 84/1.03 |

*Primary Examiner*—Stanley J. Witkowski

[57] ABSTRACT

A rhythm pattern variation device which has an address counter for generating a memory read-out address signal in accordance with a rhythm clock, a memory for outputting a prestored rhythm pattern in accordance with the address signal, means for selectively branching the outputted rhythm pattern to two lines, a variation circuit for producing a rhythm pattern of a desired time lag from the rhythm pattern on one of the two line, and means for combining the rhythm pattern on the other line and the delayed rhythm pattern from the variation circuit into a composition rhythm.

5 Claims, 13 Drawing Figures

PRIOR ART

FIG. 4A RHYTHM CLOCK
FIG. 4B ROM OUTPUT
FIG. 4C READ PULSE
FIG. 4D SHIFT CLOCK
FIG. 4E LINE 10 OUTPUT (SHIFT REG. OUTPUT)
FIG. 4F LINE 9 OUTPUT (WHEN GATE 14 ON)

RHYTHM PATTERN VARIATION DEVICE

BACKGROUND OF THE INVENTION

1. Field of the Invention

This invention relates to a rhythm pattern variation device which is capable of easily providing a variety of rhythm patterns without the necessity of increasing the capacity the memory used.

2. Description of the Prior Art

In conventional types of rhythm pattern generators, repetition of a rhythm pattern or patterns of one or more bars is stored in a read-only memory. In the case of adding variations to such rhythm pattern, the content of the read-only memory will become enormous and the circuit construction of the rhythm pattern generator will inevitably become complicated. The fundamental structure of such a conventional rhythm pattern generator is shown in FIG. 1. An address counter 2 is actuated by a rhythm clock from a rhythm clock generator 1 and, in accordance with address signals from the address counter 2, rhythm patterns stored in a read-only memory 3 are selectively provided on lines 1*a* to 1*n*. The outputs on the respective lines enable gates (1)$4_1$ to (n)$4_n$ to generate tones from tone sources $5_1$ to $5_n$. The generated tones are mixed by a mixer 6 for input to a sound system. As is seen from the above, the rhythm thus obtained is limited only to the rhythm patterns stored in the read-only memory 3, so that its memory capacity remarkedly increases with diversification of rhythm pattern.

SUMMARY OF THE INVENTION

This invention has for its object to provide a rhythm pattern variation device which is capable of easily providing a variety of rhythm patterns without increasing the capacity of the memory used.

The above objective is achieved by providing a rhythm pattern variation device which has an address counter for generating a memory read-out address signal in accordance with a rhythm clock, a memory for outputting a prestored rhythm pattern in accordance with the address signal, means for selectively branching the outputted rhythm pattern to two lines, a variation circuit for producing a rhythm pattern for a desired time lag from the rhythm pattern on one of the two lines, and means for combining the rhythm pattern on the other line and the delayed one from the variation circuit into a composite rhythm.

DESCRIPTION OF THE PREFERRED EMBODIMENTS

With reference to the drawings, this invention will hereinafter be described in detail.

Figure 1:
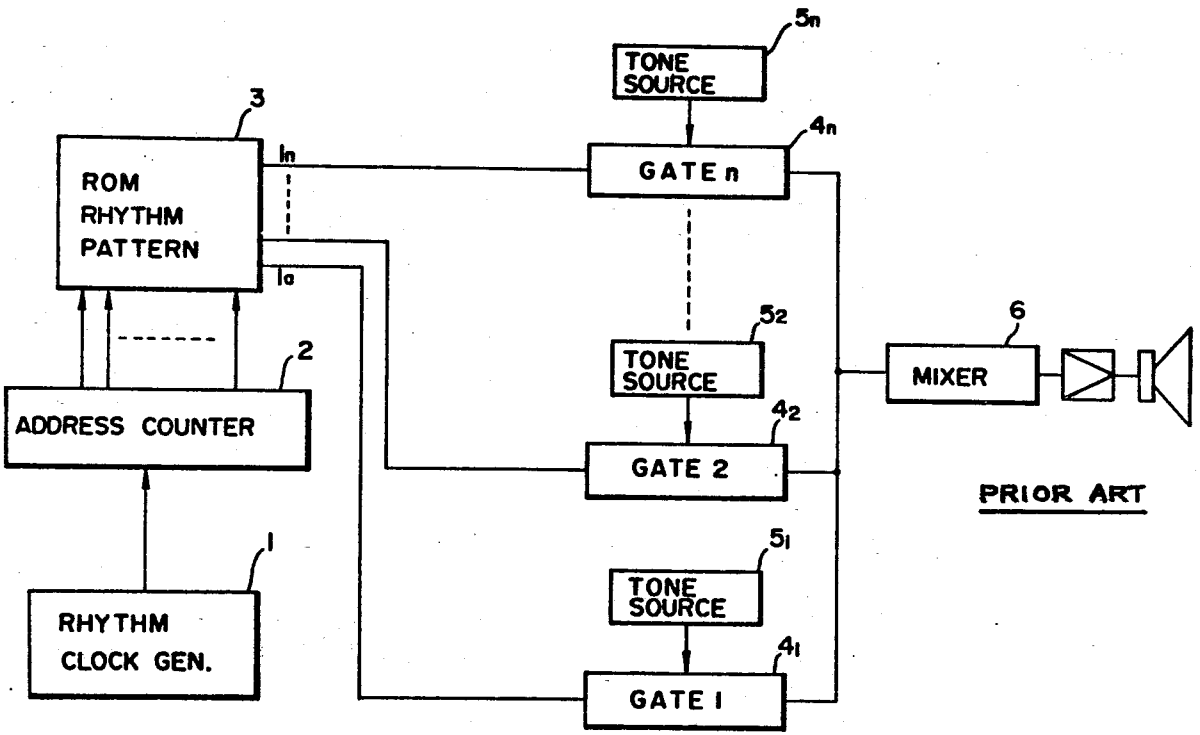
FIG. 1 is a block diagram showing the basic structure of a conventional rhythm generator.
Figure 2:
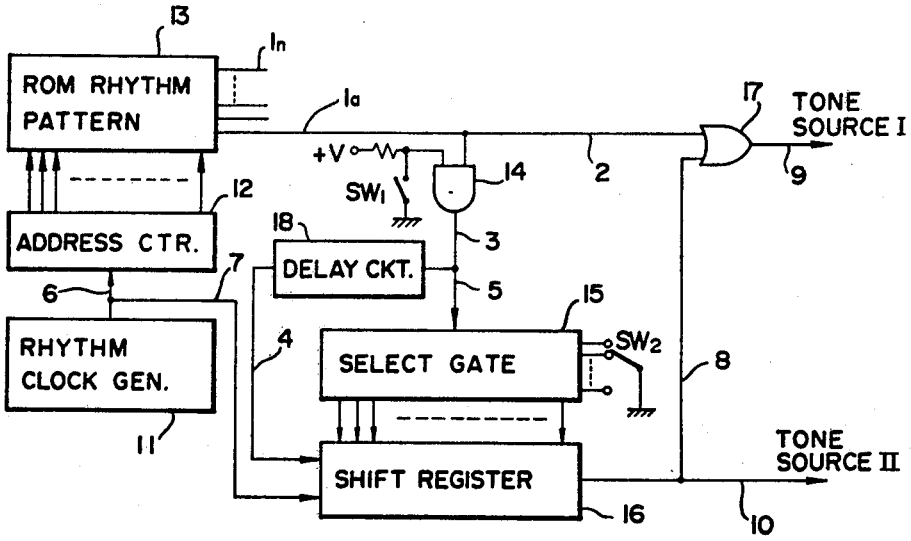
FIG. 2 is a block diagram illustrating the construction of an embodiment of this invention.

FIG. 2 is a basic block diagram showing the construction of an embodiment of this invention. An address counter 12 is actuated by a rhythm clock generator 11 to provide address signals. In accordance with these address signals, rhythm patterns stored in a read-only memory 13 are outputted on lines 1*a* to 1*n*. When a gate 14 is closed, that is, when a switch SW1 is in the ON state, the rhythm pattern provided on the line 1*a* is applied over line 2 to a tone source 1 via a gate 17. Namely, only a main rhythm pattern is provided.

Figure 3:
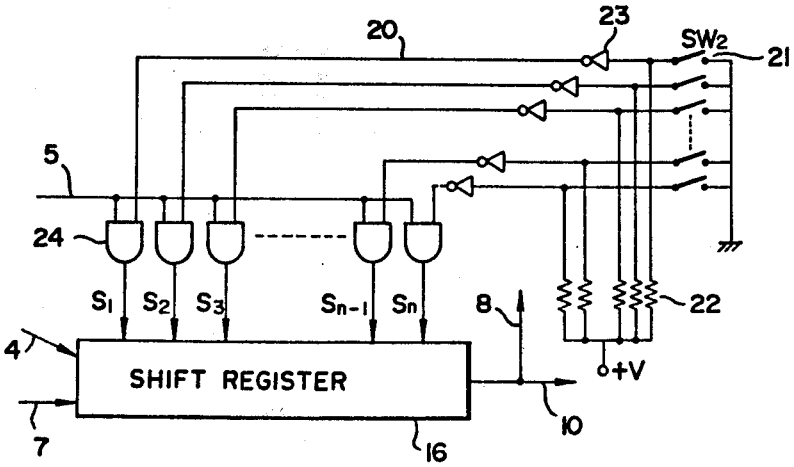
FIG. 3 is a schematic diagram showing a specific operative example of a select gate 15 used in the FIG. 2 embodiment of this invention.

When the gate 14 is open, that is, when the switch $SW_1$ is in the OFF state, the rhythm pattern is branched to lines 2 and 3. The output on the line 3 is further branched to lines 4 and 5. The pulse on the line 5 is applied to a select gate 15. A specific operative example of the select gate is shown in FIG. 3. In FIG. 3, the input to the select gate 15 from the line 5 is outputted by a switch SW2 on any one of lines $S_1$, $S_2$, . . . $S_n$, and applied to a shift register 16. On the other hand, the pulse on the line 4 is delayed by a delay circuit 18, and applied as a read-in pulse to the shift register 16. Further, the rhythm clock from the rhythm clock generator 11 is branched to be applied as a shift clock. As the output from the shift register 16, a rhythm pattern of a desired time lag is provided on a line 10 for input to a tone source II. At the same time, the output from the shift register 16 is applied to the OR gate 17 via a line 8 together with the rhythm pattern from the line 2, and combined with the latter to provide a composite rhythm pattern, which is fed to the tone source I.

FIG. 3 illustrates a specific operative example of the select gate 15 employed in the FIG. 2 embodiment, as mentioned above. In FIG. 3, lines 20 are each connected to a power source +V through a resistor 22 so that a voltage is applied to the line when the select switch (SW2) is opened. The lines 20 are each connected through an inverter 23 to one input of an AND gate 24, to the other input of which is connected the line 5 branched from the gate 14. Output lines $S_1$, $S_2$, . . . $S_n$ of the AND gates 24 are connected to the shift register 16. Let it be assumed that the output line $S_{n-1}$ is selected by the select switch 21. The rhythm pattern on the line $S_{n-1}$ is read in the shift register 16 by the read pulse applied from the line 4. Next, the rhythm pattern thus read in the shift register 16 is shifted by the rise of the shift clock from the line 7, for example, for two pulses, to provide an output on the line 10.

Figure 4:
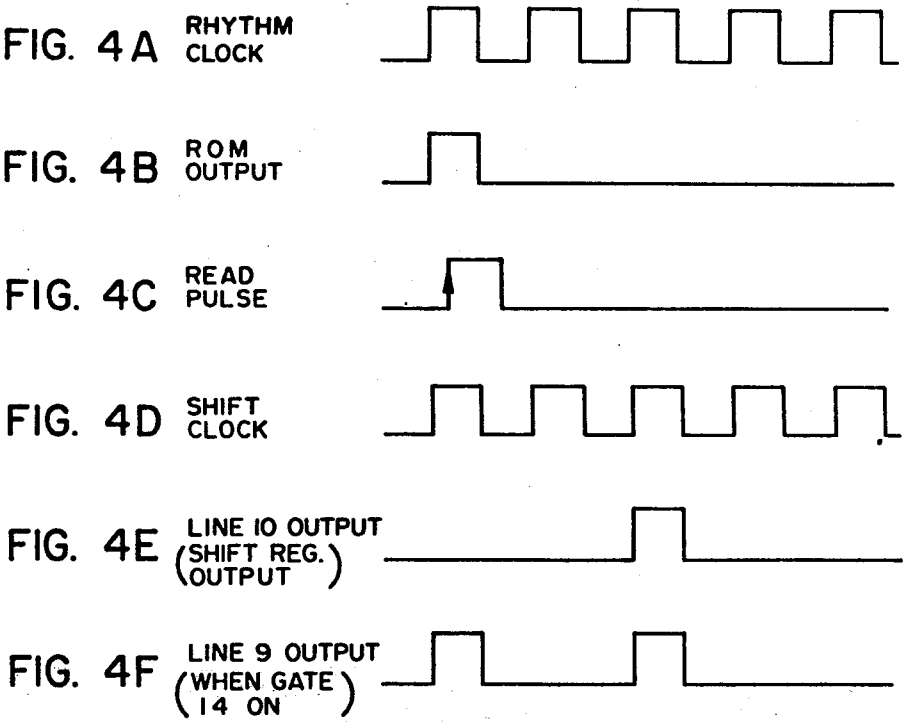
FIGS. 4A to 4F are operation waveforms of respective parts in the FIG. 2 embodiment.

FIGS. 4A to 4F show a series of operation waveform diagrams of the embodiment of this invention illustrated in FIGS. 2 and 3. FIG. 4A shows the rhythm clock generated from the rhythm clock generator 11, which clock is the same as the shift clock of FIG. 4D which is applied to the shift register 16 via the line 7. FIG. 4B shows the output read out from the read-only memory by the address signal derived from the address counter 12, illustrating the rhythm pattern appearing on the line 2 and on the line 3 when the gate 14 is in the ON state.

FIG. 4C shows the read pulse that the rhythm pattern on the line 3 is delayed by the delay circuit 18 and then applied to the shift register 16 through the line 4. By the read pulse, the rhythm pattern on a selected one of the output lines $S_1$ to $S_n$ by the select switch (SW2) 21 in the select gate 15 is read in the shift register 16. The rhythm pattern thus read in the shift register 16 is shifted by the shift clock of FIG. 4D for two pulses to provide that output on the line 10 from the shift register 16 which is shown in FIG. 4E. The output on the line 8 branched from the abovesaid output is combined by the OR gate 17 with the output on the line 2 to provide the output rhythm pattern of FIG. 4F on the line 9 when the gate 14 is in the ON state. Further variations can be obtained by applying the output on the line 10 to the tone source II different from the tone source I.

Figure 5:
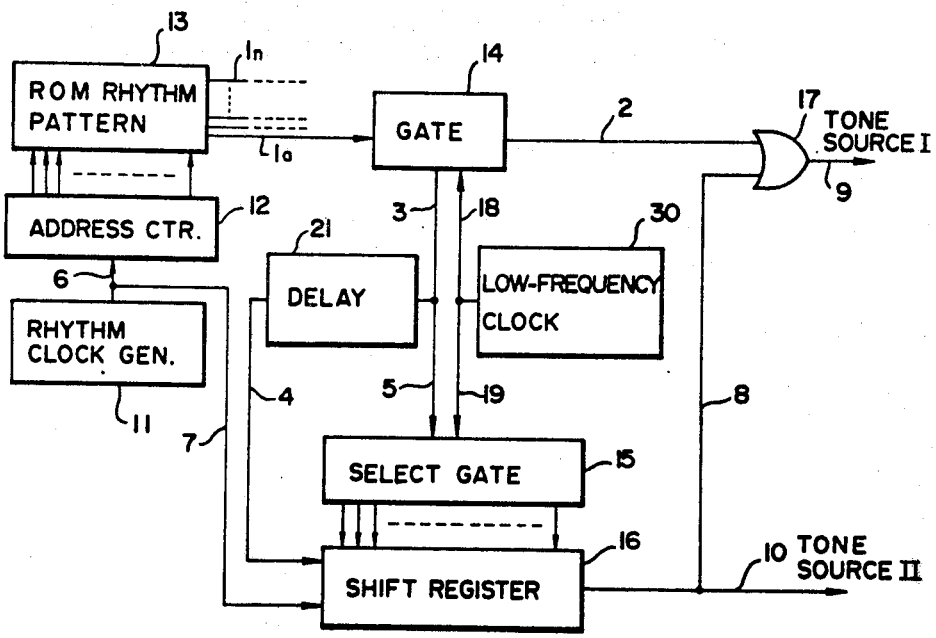
FIG. 5 is a block diagram illustrating the construction of another embodiment of this invention.

FIG. 5 illustrates in block form the construction of another embodiment of this invention. In FIG. 5, the parts corresponding to those in FIG, 2 are identified by the same reference numerals. The address counter 12 is actuated by the rhythm clock generator 11 and, in accordance with an address signal from the address counter 12, the rhythm patterns stored in the read-only memory 13 are selectively outputted therefrom on the line 1*a* to 1*n*. When the gate 14 is closed, the rhythm pattern provided on the line 1*a* is fed to the tone source I via the gate 17, providing only the main rhythm pattern. The gate 14 is controlled by a line 18 of a low-frequency clock generator 30.

Next, when the gate 14 is opened, the rhythm pattern is branched to the lines 2 and 3. The output on the line 3 is further branched to the lines 4 and 5. The pulse on the line 5 is fed to the select gate 15 which is controlled by a line 19 of the low-frequency clock generator 30, providing an output on any one of the lines $S_1$, $S_2$, . . . $S_n$. On the other hand, the pulse on the line 4 is delayed by a delay circuit 21, and applied as a read pulse to the shift register 16. Further, the rhythm clock outputted from the rhythm clock generator 11 is branched, and applied as a shift clock to the shift register 16. As the output from the shift register 16, a rhythm pattern of a desired time lag is applied to the tone source II via the line 10. At the same time, the abovesaid rhythm pattern is applied via the line 8 to the OR gate 17, and combined with the rhythm pattern from the line 2 to provide a composite rhythm pattern, which is fed via the line 9 to the tone source I.

Figure 6:
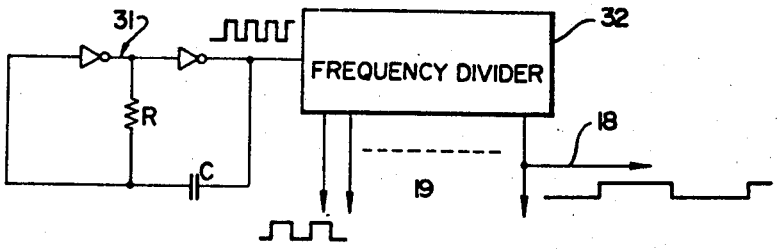
FIG. 6 is a schematic diagram showing a specific operative example of a low-frequency clock generator 30 employed in the FIG. 10 embodiment of this invention.

FIG. 6 illustrated a specific operative example of the low-frequency clock generator 30 employed in the embodiment of this invention depicted in FIG. 5. A square wave generated from an oscillator 31 is frequency divided by a frequency divider 32 to provide outputs on the lines 18 and 19. The lines 18 and 19 are respectively connected to the gate 14 and the select gate 15 to control them.

Figure 7:
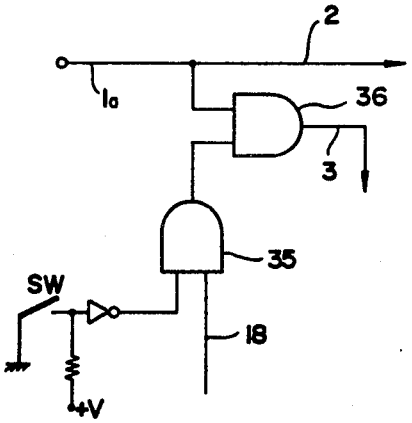
FIG. 7 is a schematic diagram showing a specific operative example of a gate used in the FIG. 5 embodiment.

FIG. 7 shows a specific operative example of the gate 14 used in the embodiment depicted in FIG. 5. The switch output is applied through an inverter to an AND gate 35 together with the output of the low-frequency clock generator 30 on the line 18. The output from the AND gate 35 is applied to an AND gate 36 together with the output branched from the line 1*a* to provide an output on the line 3. When the switch is in the OFF state, the output from the AND gate 35 is "0", so that the gate 36 is closed, providing no output on the line 3. When the switch is in the ON state, the AND gate 35 is enabled by the frequency divided output 18 from the low-frequency clock generator 30 for a certain period of time, permitting the rhythm pattern from the read-only memory 13 to be outputted on the line 3 for input to the select gate 15.

Figure 8:
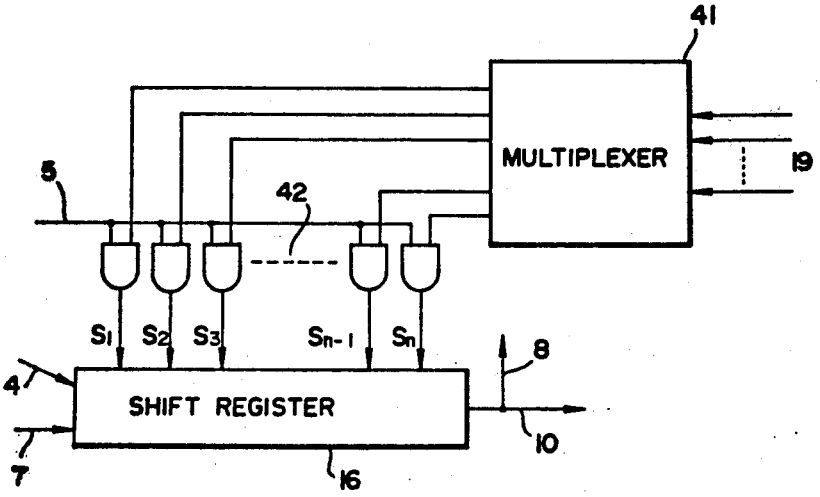
FIG. 8 is schematic diagram illustrating a specific operative example of a select gate employed in the FIG. 5 embodiment.

FIG. 8 illustrates a specific operative example of the select gate 15 employed in FIG. 5. The frequency divided output from the low-frequency clock generator 30 on the line 19 is decoded by a multiplexer (a line decoder) 41 to enable any one of AND gates 42, through which the rhythm pattern from the read-only memory 13 is applied to the shift register 16. The rhythm pattern is read by the read pulse from the line 4 in the shift register 16. Next, by the rise of the shift clock from the line 7, the rhythm pattern read in the shift register 16 is shifted for a desired number of pulses to provide an output of a certain time lag. In this instance, since the output from the low-frequency clock generator 30 is not synchronized with each bar, the select gate 15 enables the gates as if at random to provide rhythms differing with bars. This state of random rhythms is not musically inharmonic. For example, only the tone of cymbals on one of the output lines of the read-only memory produces rhythms which differ with bars, but the tones of other percussion instruments on the read-only memory output lines are produced in a constant rhythm.

The output on the line 8 branched from the output of the shift register 16 is combined with the main pulse on the line 2, and applied to the tone source I. Further variations can be obtained by applying the output from the shift register 16 to the other tone source II via the line 10.

As has been described in the foregoing, according to this invention, a rhythm pattern read out of a memory is selectively branched to two lines and the rhythm pattern on one of the two lines is applied to a variation circuit to provide a rhythm pattern of a desired time lag, which is combined with the rhythm pattern on the other line. With this method, it is possible to easily obtain variations of a rhythm pattern without increasing the capacity of the memory used.

It will be apparent that many modifications and variations may be effected without departing from the scope of novel concepts of this invention.

What is claimed is:

1. A rhythm pattern variation device comprising:
   - an address counter for generating a memory read-out address signal in accordance with a rhythm clock;
   - a memory for outputting a prestored rhythm pattern in accordance with the address signal;
   - means for selectively branching said prestored rhythm pattern to two lines;
   - a variation circuit for producing a rhythm pattern of a desired time lag from said prestored rhythm pattern on one of the two lines; and
   - means for combining said prestored rhythm pattern on the other line with the delayed rhythm pattern from the variation circuit and applying the combined patterns to a tone source circuit.

2. A rhythm pattern variation device according to claim 1, wherein the variation circuit is composed of a select gate for inputting the rhythm pattern on said one line to a shift register at a desired address and a shift register for shifting by the rhythm clock the rhythm pattern inputted to the select gate to delay the rhythm pattern for a desired period of time.

3. A rhythm pattern variation device according to claim 1, which further includes a low-frequency clock generator for generating a low-frequency clock to control the branching means and the variation circuit.

4. A rhythm pattern variation device according to claim 3, wherein the variation circuit is composed of a select gate for selecting by the low-frequency clock the address of a shift register to which the rhythm pattern on said one line is inputted, and a shift register for shifting by the rhythm clock the rhythm pattern inputted to the select gate to delay the rhythm pattern for a desired period of time.

5. A rhythm pattern variation device according to claim 3, wherein the low-frequency clock generator generates a plurality of clocks of different frequencies.

* * * * *